US005631630A

United States Patent [19]

McSweeney

[11] Patent Number: 5,631,630

[45] Date of Patent: May 20, 1997

[54] LOW VOLTAGE POOL SECURITY SYSTEM

[76] Inventor: Terrance J. McSweeney, 1135 Landers St., Ormond Beach, Fla. 32174

[21] Appl. No.: 529,533

[22] Filed: Sep. 18, 1995

[51] Int. Cl.[6] ..... G08B 19/00

[52] U.S. Cl. ..... 340/522; 340/541; 340/573; 340/508; 340/552; 340/550

[58] Field of Search ..... 340/522, 541, 340/573, 508, 528, 552, 550

[56] References Cited

U.S. PATENT DOCUMENTS

| | | | |
|---|---|---|---|
| 4,103,293 | 7/1978 | La Farge, Jr. | 340/522 |
| 4,331,952 | 5/1982 | Galvin et al. | 340/522 |
| 4,386,275 | 5/1983 | Kalmowitz et al. | 340/541 |
| 4,820,938 | 4/1989 | Mix et al. | 340/552 |
| 4,982,176 | 1/1991 | Schwartz | 340/567 |
| 5,019,802 | 5/1991 | Brittain et al. | 340/522 |
| 5,023,593 | 6/1991 | Brox | 340/522 |
| 5,102,103 | 4/1992 | Putnam | 340/541 |
| 5,386,210 | 1/1995 | Lee | 340/522 |
| 5,463,595 | 10/1995 | Rodhall et al. | 340/522 |

*Primary Examiner*—Jeffery Hofsass
*Assistant Examiner*—Benjamin C. Lee
*Attorney, Agent, or Firm*—Richard C. Litman

[57] ABSTRACT

A simplified, home-improvement-type, low voltage security system to prevent infants from entering the swimming pool area by monitoring the exit doors of a home leading to the swimming pool and the swimming pool by combined passive and active motion detectors and an alarm. Photoflood lamps can be added to the security system.

18 Claims, 1 Drawing Sheet

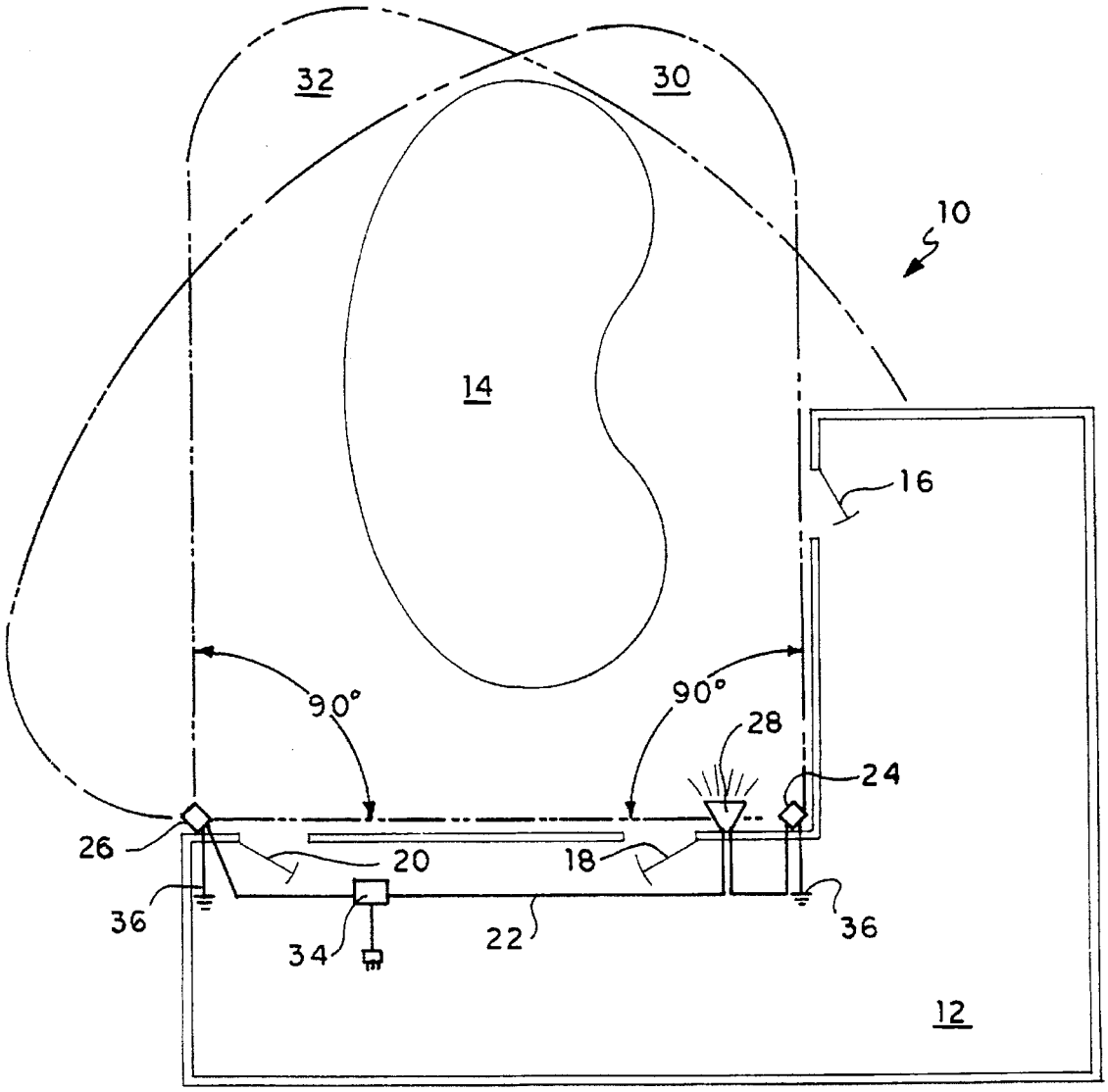
32
30
10
14
16
90°
90°
28
24
26
20
18
36
34
22
36
12

LOW VOLTAGE POOL SECURITY SYSTEM

BACKGROUND OF THE INVENTION

1. Field of the Invention

The present invention relates to a simplified, home-improvement low voltage swimming pool security system which any home owner can readily install to prevent the infants and youngsters from falling into the swimming pool and for normal protection against unwanted intrusion to the rear of the home.

2. Description of the Prior Art

It is not uncommon for swimming pool owners to encounter the sad occurrence of an infant or youngster entering the pool premises unknown to the adults present inside the home, and discovering to their horror that the infant had drowned in the pool. This sad fate could be prevented in the installation by the home owner of a security system which would alert the adults inside the home when the infant leaves the house and enters the pool premises.

The prior art has not considered the danger of infants entering the backyard swimming pool premises and an economical method of preventing a fatal accident from occurring by monitoring the doors leading to the pool as well as the pool. The following prior art teachings will be considered in the order of their perceived relevance to applicant's invention.

In U.S. Pat. No. 5,023,593 issued on Jun. 11, 1991, to Steven E. Brox, a passive infrared and an underwater acoustic element containing pool security system is described. The thin infrared layer overlays the water surface. The acoustic element placed below the water surface detects the waves created as a body enters the water. A master control unit determines when to generate an alarm by a predetermined time interval between the detections of the two elements. The body detecting elements are positioned within the pool. In contradistinction thereto, applicant's motion detectors are positioned away from the pool, observe exiting of a body from the house, and do not require an acoustic element.

In U.S. Pat. No. 4,820,938 issued on Apr, 11. 1989, to Jerome M. Mix et al., a low voltage motion sensor for activating a high voltage load is described. The motion sensors detect motion in a room and activate lights. The motion sensor detects doppler shifts in transmitted ultrasonic sound. On the other hand, applicant's method depends on detecting physical presence by a passive infrared and microwave detector.

In U.S. Pat. No. 5,311,166 issued on May 10, 1994, to Filmore O. Frye, a security system for a vestibule comprising a speaker, a siren and a flashing light to attract outside attention is described. Deterrent devices such as devices which disperse foul scents, dispense dyes to mark the perpetrator, disperse water at varying temperatures, and discharge electrical shock are employed in conjunction with this security system. Such a system could not be employed to protect a swimming pool from intrusion, In U.S. Pat. No. 5,386,275 issued on May 31, 1983, to Sheldon Kalmowitz et al., an apparatus and method for the detection of a heat-emitting body is described. This apparatus is intended to detect the presence of a person in a room. Infrared sensors on detecting a person will turn on lights or activate a burglar alarm. In addition, the system will deactivate the lights or appliances when the last person leaves the room. This disclosure does not contemplate the system protecting a swimming pool from intrusion.

In U.S. Pat. No. 5,102,103 issued on Apr. 7, 1992, to Theo 0. Putnam, a child safety fence for preventing unsupervised children from entering swimming pools is described. Posts support a flexible line which supports a netting. The line is connected to an audible alarm signal which is activated by any weight on either the line or netting. This type of protection would be expensive to protect a backyard pool of any sizable dimensions.

None of the above inventions and patents, taken either singly or in combination, is seen to describe the instant invention as claimed.

SUMMARY OF THE INVENTION

Accordingly, it is a principal object of the invention to provide an economical do-it-yourself pool security system for a homeowner who desires peace of mind when infants are present.

It is another object of the invention to provide a low voltage pool security system with a battery backup.

It is a further object of the invention to provide a motion detector and alarm system for alerting one to the unauthorized use of a swimming pool.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWING

The Drawing Figure is a plan view of a home with a backyard kidney-shaped swimming pool protected by two combined infrared and microwave motion detectors, a siren alarm, and backup batteries.

The security system 10 for an exemplary elbow shaped home 12 having an exemplary kidney-shaped pool 14 and doors 16, 18 and 20 leading to the pool comprises an electrical circuit 22 with two motion detectors 24 and 26 and a siren or alarm 28. The 90 degree coverage of the signal pattern 30 of motion detector 24 overlaps the 90 degree signal pattern 32 of motion detector 26 to double cover the doors 16, 18 and 20. The security system 10 is energized by a household voltage of 120 V. A.C. which is stepped down to 14 V. D.C. by a plug-in transformer 34. Therefore, backup 12 V. D.C. batteries 36 are provided for each motion detector 24 and 26.

DETAILED DESCRIPTION OF THE PREFERRED EMBODIMENT

The present invention provides for a do-it-yourself homeowner who can install a simple pool security system to either prevent infants from entering the pool area or to warn the homeowner of uninvited intrusion in one's backyard. The security system comprises two motion detectors 24 and 26. The number of motion detectors required for a home with an outdoor pool is discretionary and would depend on the configuration of the home and of the pool. The figure is exemplary in that one or more motion detectors can be employed. One detector would cover the area, but two detectors are disclosed for the benefit of a backup system.

Motion detectors are commercially available from C & K Systems, Inc. (TM) and Dual-Guard (TM). These motion detectors operate on two technologies, i.e., passive infrared and active microwave. The active passive infrared technology responds to changes in infrared energy such as body heat emitted by an intruder. The microwave senses motion to verify intrusion. Since these two technologies work together, false alarms are virtually eliminated. These motion detectors can weigh from 6–12 oz. and are swivel-mounted on walls or in corners at a height of approximately 7.5 feet. The coverage of the fan-shaped patterns 30 and 32 can be as wide as 40 to 20feet at the outermost edge at a distance of 40 to 100 feet. These combined passive and active detectors can operate at a temperature range of 32° to 120° F. and a relative humidity range of 5% to 95%. Immunity to radio frequencies is at an amplitude of 30 Volts/meter for a frequency range of 10 to 1,000 megahertz, which means that interference from a homeowner's mobile telephone would not interfere with the operation of these passive motion detectors. The center band frequency of the microwave is 10.5 gigahertz in the United States. The combined passive and active motion detectors have an independent internal circuit which supervises the microwave signal against failure by energizing the alarm when there is any loss of the microwave signal.

The main interest for utilizing this innovative security and alarm system is to prevent the possible calamitous loss of a loved infant or youngster who unfortunately wanders out from an open or closed door to the pool area. This system provides adequate warning to someone inside the home that the infant or youngster has wandered into the pool area by supervising not only the swimming pool but also the exits leading to the pool.

The siren or alarm 28 can be located either outside the home as in the Figure, inside the home or in both locations as preferred by the occupants. The intensity and duration of the alarm or siren 28 can be modified to suit the inhabitants and to conform with the siren requirements of the local fire department. An exemplary self-contained siren is available from C & K Systems (TM) with a power input of 9–18 V. D.C. or 250 milliamperes at 1 V. D.C. The siren output is 107 decibels at one yard distance which output can be adjusted to a single tone or a two-tone emission.

The security system 10 can be initiated and terminated by several methods. Firstly, an in-line switch (not shown) can be inserted into the circuit 22 on the load side of the transformer 34. Secondly, a plug-in timer with on/off tabs to program the hours of operation (not shown) commercially available for use on lighting fixtures, can be added. to the plug (shown) of the transformer 34. Thirdly, the homeowner could energize the security system 10 by simply manually connecting the plug of the transformer 34 to the electrical source.

The addition of photoflood lamps with light sensors (not shown) operating on 9 to 24 V. D.C., preferably 12 V. D.C. can be added to the security system 10 so as to light the pool area upon intrusion in the evenings. Also, the substitution of a wireless security system is within the ambit of this invention, but would add substantially to the cost of the installation of a security system.

Of course, this security system 10 can be useful for the warning of intruders and prevention of intrusion, be it wild animals, uninvited people or burglars, while the home is unoccupied.

It is to be understood that the present invention is not limited to the sole embodiment described above, but encompasses any and all embodiments within the scope of the following claims.

I claim:

1. A low voltage security system devoid of computerized control for securing a backyard swimming pool and exit doors of a home and installable by a homeowner consisting of:

a low voltage electrical circuit containing:

at least two combined passive and active motion detector means positioned to each cover the swimming pool and exit doors of a home leading to said swimming pool with overlapping coverage, wherein at least one said motion detector means is a backup for another said motion detector means;

said at least two combined passive and active motion detector means directly connected to a transformer means which converts alternating current house voltage to a low direct current voltage for energizing said at least two combined passive and active motion detector means;

alarm means; and a plug means which connects said transformer means to said house voltage; and a plurality of photoflood lamps, whereby upon activation by the at least two combined passive and active detectors, illuminate the pool and exit doors;

whereby an intrusion to the backyard swimming pool and exit from exit doors can be detected by said at least two passive and active motion detector means and activates said alarm means and said plurality of photoflood lamps to alert any occupants of the house of the impending danger of intrusion, and said low voltage security system being installable by the homeowner and being devoid of computerized control.

2. The low voltage security system according to claim 1, wherein the low voltage is no more than 14 Volts D.C.

3. The low voltage security system according to claim 1, including an in-line switch in said electrical circuit.

4. The low voltage security system according to claim 1, including a plug-in timer inserted in said electrical circuit.

5. The low voltage security system according to claim 1, including an alarm means located outside the home.

6. The low voltage security system according to claim 1, including an alarm means located inside the home.

7. The low voltage security system according to claim 1, including alarm means located outside and inside the home.

8. The low voltage security system according to claim 1, wherein said at least two combined passive and active motion detector means are operative to produce passive infrared energy and active microwave energy.

9. The low voltage security system according to claim 1, wherein said at least two combined passive and active motion detector means each has an adjacent backup battery.

10. A method of securing a backyard swimming pool and exit doors of a home form intrusion with a low voltage security system devoid of computer control and installable by a homeowner consisting of:

providing at least two combined passive and active motion detectors positioned to each cover an area comprising the backyard swimming pool and exit doors of a home leading to said swimming pool with overlapping coverages,wherein one motion detector is a backup for the other detector;

providing a low voltage source to energize the at least two combined passive and active motion detectors;

providing an alarm which is activated when the at least two combined passive and active motion detectors detect an intruder entering the covered area; and providing a plurality of photo-floodlamps in the swimming pool area, said photo-flood lamps being activated by said at least two combined passive and active motion detectors detecting an intruder;

whereby a homeowner is alerted to the intrusion into the swimming pool area and the exit doors of the home by the alarm and the illumination from the photofloodlamps, and which low voltage security system being installable by the homeowner and being devoid of computer control.

11. The method according to claim 10, wherein the low voltage source provided is not more than 14 Volts D.C.

12. The method according to claim 10, wherein an in-line switch is provided to operate the at least two combined of passive and active motion detectors.

13. The method according to claim 10, wherein a plug-in timer is provided to operate the at least two combined of passive and active motion detector, whereby the hours of operation can be programmed.

14. The method according to claim 10, wherein the alarm is located outside the home proximate to the swimming pool area.

15. The method according to claim 10, wherein the alarm is located inside the home to alert an occupant of the home.

16. The method according to claim 10, wherein the alarm includes alarm means located outside the home proximate to the swimming pool area and alarm means located inside the home to alert an occupant of the house.

17. The method according to claim 10, wherein the at least two combined passive and active motion detector are operative to produce passive infrared energy and active microwave energy.

18. The method according to claim 10, wherein the at least two combined passive and active motion detectors are operative to detect infants entering the swimming pool area from the exit doors of the home.

* * * * *